United States Patent [19]

Hollis

[11] 3,963,362

[45] June 15, 1976

[54] ROAD MARKER

[75] Inventor: Jack L. Hollis, Mechanicsburg, Pa.

[73] Assignee: Carlisle Corporation, Carlisle, Pa.

[22] Filed: Nov. 27, 1974

[21] Appl. No.: 527,873

[52] U.S. Cl. ..... 404/10; 350/107
[51] Int. Cl.[2] ..... E01F 9/00; G02B 5/132
[58] Field of Search ..... 404/10, 11, 15, 16

[56] References Cited

UNITED STATES PATENTS

| | | | |
|---|---|---|---|
| 1,676,843 | 7/1928 | Stephens | 404/10 |
| 1,707,951 | 4/1929 | Schleicher | 404/10 |
| 1,766,073 | 6/1930 | Hartzler | 404/10 |
| 1,766,841 | 6/1930 | Sherman | 404/10 |
| 1,773,488 | 8/1930 | Hines | 404/10 |
| 1,901,333 | 3/1933 | Parkhurst | 404/10 |
| 3,340,779 | 9/1967 | Mahoney | 404/10 |
| 3,362,305 | 1/1968 | Pellowski | 404/10 |

*Primary Examiner*—Nile C. Byers
*Attorney, Agent, or Firm*—Ulle C. Linton

[57] ABSTRACT

A road with at least one light reflective marker marking a portion or lanes of a highway so that the road portion or lanes are more easily identified particularly at night or when rain or snow is present and which arrangement provides one marker or markers with spaced apart reflection elastomeric projections above the surface of the highway along longitudinal lines of the highway with each projection being a marker partially embedded in the roadway on an angle inclined away from the direction of flow of traffic on the section of the highway including the marker.

6 Claims, 13 Drawing Figures

ROAD MARKER

BACKGROUND OF THE INVENTION

Highways particularly at night or when snow covered or when it is raining or snowing, are difficult for drivers of vehicles thereon to follow the edges of the highway or lanes thereof and it is conventional to paint lines longitudinally on the highway or mount projecting guides to indicate said edges or lanes, but such painted lines, or projections are difficult to see at night or when it is raining or snowing or are snow covered and known projections are damaged or removed when struck by snowplows clearing snow from the highway.

The following are know prior patents relating to such road markers;

U.S. Patent Nos:

| | |
|---|---|
| 1,640,830 | 1,668,288 |
| 1,661,242 | 1,676,843 |
| 1,688,409 | 2,345,644 |
| 1,707,951 | 2,541,460 |
| 1,766,841 | 2,779,240 |
| 1,773,488 | 3,091,977 |
| 1,804,389 | 3,175,935 |
| 1,901,333 | 3,240,132 |
| 1,903,869 | 3,298,555 |
| 1,915,179 | 3,308,584 |
| 1,948,335 | 3,312,156 |
| 1,949,295 | 3,340,779 |
| 1,961,580 | 3,362,305 |
| 1,981,206 | 3,409,344 |
| 2,005,170 | 3,417,676 |
| 2,108,370 | 3,418,896 |
| 2,121,961 | 3,442,187 |
| 2,318,722 | 3,575,773 |
| 3,693,511 | |

SUMMARY OF THE INVENTION

The present road marker provides for a reflective elastomeric projection above the surface of the highway with a plurality of said markers installed in the same position as would normally be used to identify edges or lanes on the highway with painted strips, but the markers would be installed on the highway approximately ten feet apart and each marker inclined at an angle of approximately 60° to the highway surface away from the direction of highway traffic flow with the reflective side of the marker facing the traffic.

The principle object of the invention is to provide replaceable road markers that indicate portions of or lines on a highway to oncoming motorists and yet which markers when hit by a vehicle tire or snow plow blade, would deflect rather than be destroyed.

DESCRIPTION OF THE PREFERRED EMBODIMENTS

Figure 1:
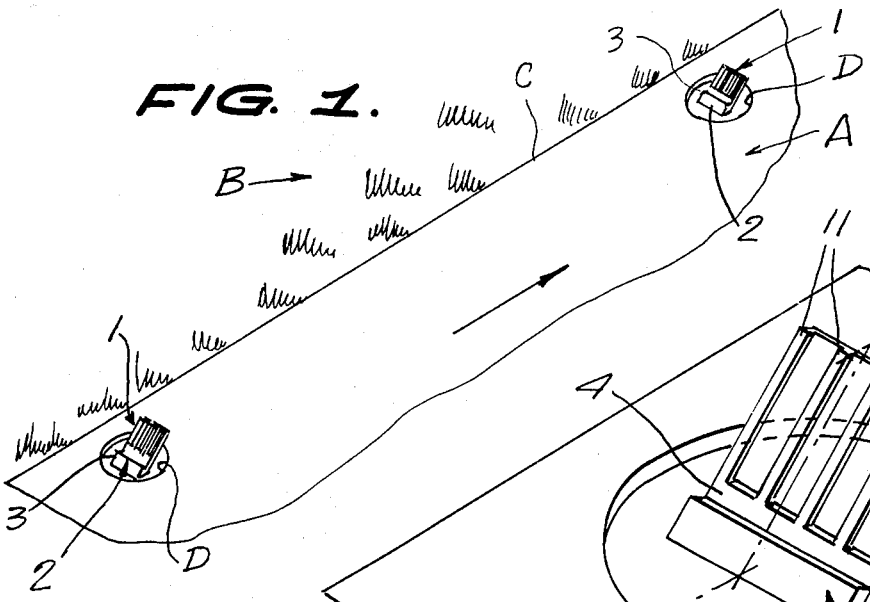
FIG. 1 is a top perspective view of an edge portion of a highway incorporating the present markers.
Figure 2:
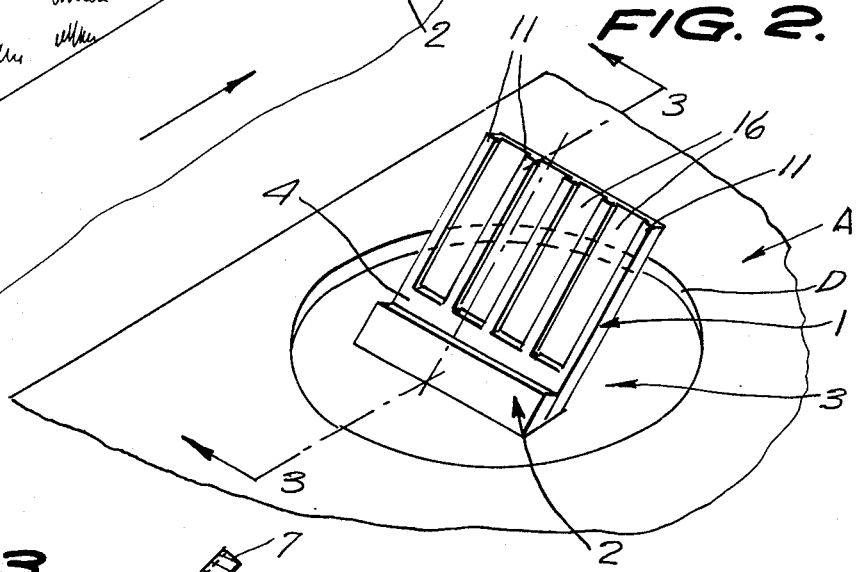
FIG. 2 is an enlarged perspective view of one of the markers in a portion of a highway.

Referring now more particularly to the accompanying drawings wherein like and corresponding reference characters refer to similar elements, A generally designates a conventional road or highway with the ground alongside the edge of the road.

Road or highway A has a series of recesses D provided therein as by drilling for example and recesses D are spaced apart in a series along an imaginary line representing the side or boundary of a lane extending longitudinally of road A.

A roadmarker 1 is of a general rectangular configuration and in one piece of an elastomeric material.

A plug 2 is of a generally square configuration and is also made of one piece of elastomeric material.

Roadmarker 1 and plug 2 are each retained in one of said recesses D by an epoxy, concrete, asphalt or like material 3 as will be explained hereafter more in detail.

Each roadmarker 1 has a flat top 4, straight parallel sides 5 and 6, straight parallel ends 7 and 8 and flat bottom 10 parallel to top 4 with hole 9 extending from top 4 through to bottom 10 in one end portion of said roadmarker. A series of parallel straight recesses are provided in the other end portion of top 4 and open at end 7. Each of said recesses are provided by side walls 11 and 13 connected by bottom 12 providing ribs 14 and 15 contiguous with top 4.

Light reflective strips 16 are each seated on and affixed to one of said bottoms 12. Said strips 16 are formed from light reflective material such as produced by the Minnesota Mining and Manufacturing Company, having light reflective glass beads affixed to a flexible material.

As a specific example of the present roadmarker, sides 5 and 6 can be five inches long and one-quarter inches wide, with ends 7 and 8 extending two inches between said sides. Holes 9 can have a .875 inch diameter on a center one inch from end 8 and either side 5 or 6. Each rib 14 or 15 can be two and one-quarter inches long with sides 11 and 13 each one-quarter inch deep and bottoms 12 each three-eighths of an inch wide.

Plugs 2 can be two by two and five-eighths on their sides and one-quarter inch thick.

Holes D can be two and one-eighth inch deep and have a four inch diameter.

Holes D can be spaced ten feet apart along road A.

Figure 3:
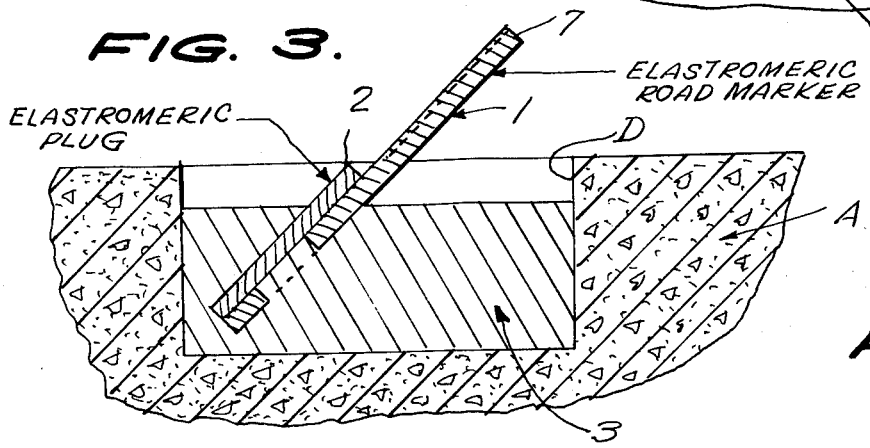
FIG. 3 is a sectional view taken on line 3—3 of FIG. 2.
Figure 7:
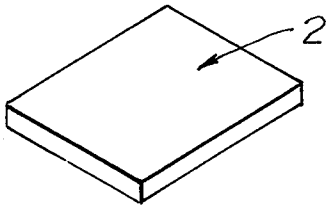
FIG. 7 is a perspective view of the plug for mounting the marker.
Figure 4:
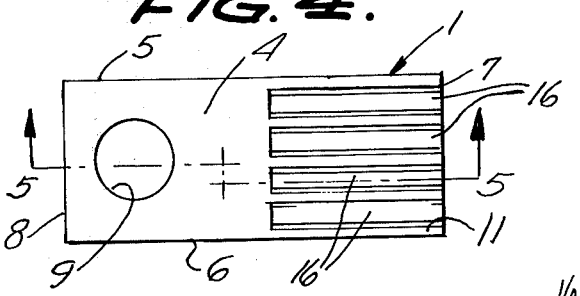
FIG. 4 is a top view of the marker.
Figure 5:
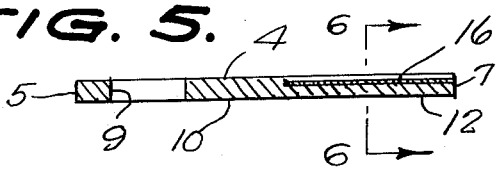
FIG. 5 is a sectional view taken on line 5—5 of FIG. 4.
Figure 6:
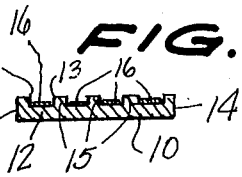
FIG. 6 is a cross-sectional view taken on line 6—6 of FIG. 5.

In the mounting of the roadmarkers 1 and plugs 2, each roadmarker 1 is positioned in a hole D before the filling 3 is added, with the roadmarker hole 9 at the lower end and the roadmarker on about a sixty degree slant to the surface of road A. A plug 2 is laid on top of the lower end of the roadmarker as shown in FIG. 3 and the roadmarker and plug held by a fixture (not shown) or manually while a pourable material such as concrete, epoxy, asphalt or the like is poured into hole D below the top thereof leaving about three-eighths between the top of material 3 and the surface of road A, so that material 3 flows into opening 9 and around the lower portions of roadmarker 1 and plug 2 and is allowed to harden leaving the portion of roadmarker with reflective strips above the surface of road A. The roadmarker 1 slants away from the direction of the flow of traffic for its location, but with strips 16 facing oncoming vehicles whose lights will be reflected thereby to the eyes of the vehicle driver.

Should any of the roadmarkers 1 be worn or damaged in use, it is only necessary to remove the accompanying plug 2 by applying a force on the plug away from the road surface removing the plug from material 3 leaving a space into which the roadmarker can be lifted above the plug of material 3 in hole 9 and then the roadmarker can be slid from material 3. A new roadmarker can then be slid into the slot in material 3 until the new hole 9 receives the plug of material 3 left behind and a new plug 2 slid into the position as shown in FIG. 3.

Figure 8:
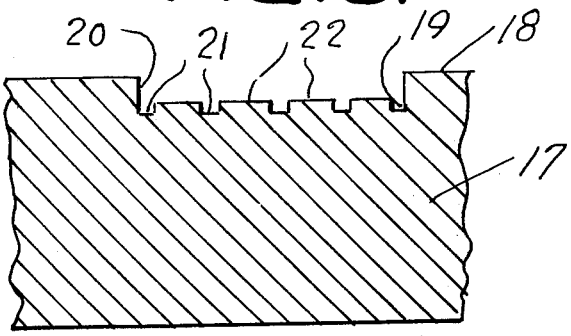
FIG. 8 is a partial cross-sectional view of a die for forming continuous strips of the present marker by extrusion

Roadmarkers 1 can be formed by extruding a continuous strip of uncured rubber composition past a die as shown in FIG. 8, cut into individual roadmarkers and cured in a steam autoclave. Said die would have continuous recesses with side walls 19 and 20 with further recesses 21 providing raised portions 22. Reflective strips 16 would move along raised portions 22 and thus adhere to the rubber strips moving therealong so that roadmarker 1 with recesses 11-13 along their entire length would be provided. Holes 9 could be cut from the resulting roadmarkers.

Figure 11:
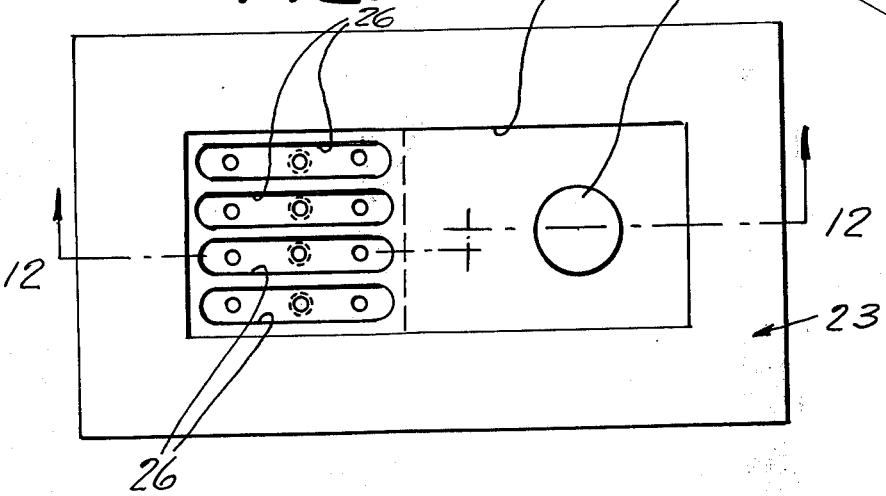
FIG. 11 is a top view of a mold without inserts for forming the present markers.
Figure 12:
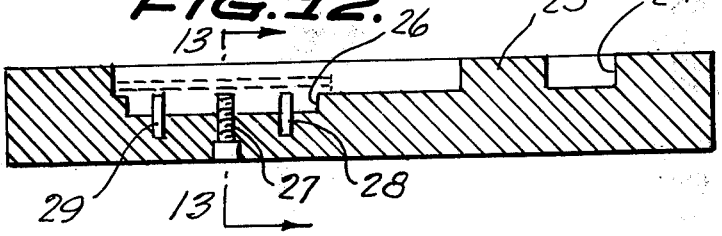
FIG. 12, is a sectional view taken on line 12—12 of FIG. 11, and, FIG. 13 is a cross-sectional view taken on line 13—13 of FIG. 12 with said inserts mounted in said mold.
Figure 13:
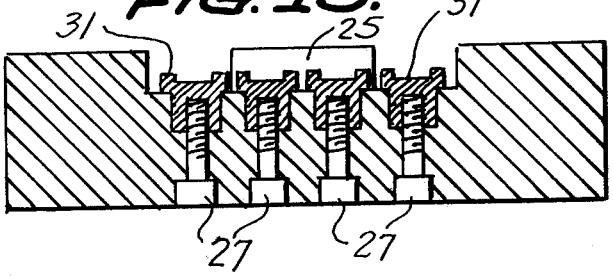

Alternately the roadmarkers 1 could be molded using a normal rubber compression mold 23 as shown in FIGS. 11-13. Said mold would have a rectangular recess 24, annular knob 25 and sub-recess 26. Screws 27 and pins 28 and 29 extend into sub-recess 26.

Figure 9:
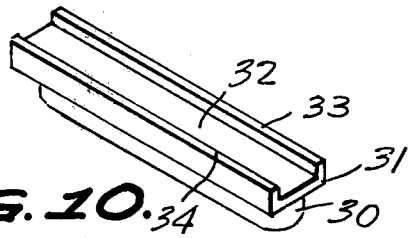
FIG. 9 is a top perspective view of a mold insert.
Figure 10:
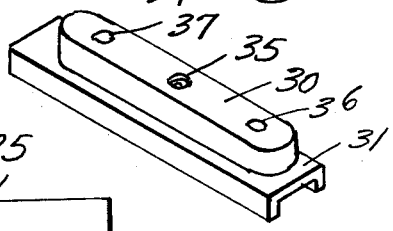
FIG. 10 is a bottom perspective view of said insert.

Inserts as shown in FIGS. 9 and 10 having bottom portions 30 shaped to mate with a recess 26 and U-shaped top portion 31 with ribs 33 and 34 and bottom 32, would be mounted in recesses 26 with pins 28 and 29 in holes 36 and 37 and screws 27 in threaded holes 35 as shown in FIG. 13. Reflective strips 16 would be placed on bottoms 32 and uncured rubber composition placed in recess 24 and the mold closed in a conventional manner forming a completed roadmarker 1.

It is to be appreciated that the shapes and sizes described hereinbefore can be varied to suit individual needs.

I claim:

1. A road with light reflective markers comprising a road having at least one hole in the surface thereof, a resilient roadmarker having a hole extending therethrough from one face to an opposite face of said roadmarker, at least one light reflective member mounted on one of said faces of said roadmarker, said roadmarker being partially positioned in said road hole with said light reflective material extending above the road surface, a solid plug being seated on one of said faces of said roadmarker in said road hole and covering the opening of said roadmarker hole on said one of said faces and retaining means filling said road hole, said roadmarker hole from the other of said roadmarker faces and extending along said roadmarker and plug portions in said road hole.

2. A road with light reflective markers as claimed in claim 1 wherein said road has a plurality of said holes spaced apart longitudinally of said road, a plurality of said roadmarkers are each positioned in one of said holes, a plurality of said light reflective members are mounted on each of said roadmarkers and extend above said road surface facing oncoming traffic, a plurality of said plugs are each mounted on one of said roadmarkers over the opening of the hole in said one of said faces of said roadmarker, and said retaining means fills each of said road holes and extends around the portions of said roadmarker and plugs in said holes.

3. A road with light reflective marker as claimed in claim 1 wherein each of said roadmarker in an elastomeric member having at least one of said faces being a flat face and at least one recess in said flat face and said light reflective member is fixedly mounted in said recess.

4. A road with light reflective marker as claimed in claim 3 wherein said plug is elastomeric member having a flat face seated on a portion of said roadmarker flat face over said roadmarker hole.

5. A road with light reflective marker as claimed in claim 4 wherein said retaining means is a rigid material affixed to said road below the top of said road hole and having a slot with a stop extending into said slot and said roadmarker and plug are superimposed in said slot with said stop extending only in said roadmarker hole.

6. A road with light reflective marker as claimed in claim 2 wherein said roadmarkers extend on a slant to said road surface away from the direction of oncoming traffic.

* * * * *